US007503087B2

(12) United States Patent
Kim et al.

(10) Patent No.: US 7,503,087 B2
(45) Date of Patent: Mar. 17, 2009

(54) WASHING MACHINE CONTROL METHOD

(75) Inventors: Jong Ho Kim, Changwon-si (KR); Byung Chan Kim, Miryang-si (KR)

(73) Assignee: LG Electronics Inc., Seoul (KR)

( * ) Notice: Subject to any disclaimer, the term of this patent is extended or adjusted under 35 U.S.C. 154(b) by 719 days.

(21) Appl. No.: 10/717,931

(22) Filed: Nov. 21, 2003

(65) Prior Publication Data

US 2004/0148709 A1 Aug. 5, 2004

(30) Foreign Application Priority Data

Nov. 26, 2002 (KR) ..... 10-2002-0073874

(51) Int. Cl.
*D06F 35/00* (2006.01)

(52) U.S. Cl. ..... 8/158; 68/12.23; 68/12.04; 68/12.02; 68/12.27

(58) Field of Classification Search ..... 8/158
See application file for complete search history.

(56) References Cited

U.S. PATENT DOCUMENTS 4,779,430 A * 10/1988 Thuruta et al. ..... 68/12.04
5,671,493 A * 9/1997 Moon ..... 8/159
5,768,728 A * 6/1998 Harwood et al. ..... 8/158
5,987,679 A * 11/1999 Won ..... 8/158

FOREIGN PATENT DOCUMENTS

| | | | |
|---|---|---|---|
| JP | 06039183 | * | 7/1992 |
| JP | 06039183 A | * | 7/1992 |
| JP | 06-039183 | | 2/1994 |
| KR | 1996-23421 | | 6/1996 |
| KR | 19960023421 | * | 6/1996 |
| KR | P19960023421 A | * | 6/1996 |

* cited by examiner

*Primary Examiner*—Michael Barr
*Assistant Examiner*—Jason P Riggleman
(74) *Attorney, Agent, or Firm*—McKenna Long & Aldridge LLP

(57) ABSTRACT

A method for controlling a washing machine is provided. The washing machine may include a door having means for determining an opened state or a closed state. The method may include sensing a first wet laundry amount after initiating a wash cycle of a wash course, sensing a second wet laundry amount upon detection of an open state of the door during the wash cycle. Control of the wash course may be based on the first wet laundry amount, if the open state of the door is not detected during the wash cycle, or control of the wash course may be based on the second wet laundry amount if the open state of the door is detected during the wash cycle.

3 Claims, 3 Drawing Sheets

WASHING MACHINE CONTROL METHOD

This application claims the benefit of Korean Application No. 10-2002-0073874 filed on Nov. 26, 2002, which is hereby incorporated by reference.

BACKGROUND OF THE INVENTION

1. Field of the Invention

The present invention relates to a washing machine, and more particularly, to a method of sensing a current laundry amount during a wash cycle of a washing machine.

2. Discussion of the Related Art

In a typical washing machine, a user puts laundry in a tub via a door, applies power to the machine, inputs a washing command, and starts a wash cycle of a wash course. Then, a controller controls a load driver according to the washing command input and other factors, such as a sensed amount of laundry.

Referring to FIG. 1, a washing machine according to a related art is comprised of a key input unit 1 for inputting a user command, a voltage sensing unit 2 for outputting a voltage signal in accordance with a sensed amount of laundry, a controller 3 for outputting a control signal for controlling steps of the washing machine once a start button of the key input unit has been pressed, a load driver 4 for driving a motor, valves, and the like (not shown) according to the control signal of the controller. The voltage signal output of the voltage sensing unit 2 is a number of pulses proportional to the amount of laundry in the tub. The pulses are input to the controller 3, which counts the number of the pulses to determine the laundry amount and a corresponding water level.

Referring to FIG. 2, illustrating an operating method of the above washing machine, the washing machine is powered-on in a step S1. With laundry loaded into the washing machine, a user selects a wash course in a step S2 and then starts the operation in a step S3. Thereafter, prior to the tub filing with water, the amount of dry laundry in the tub is sensed in a step S4. Subsequently, in a step S5, water is supplied according to the sensed laundry amount. Finally, after a predetermined water level is reached, washing is performed in a step S6 according to the sensed laundry amount. The washing step typically includes a predetermined cycle of washing, rinsing, and dewatering performed according to the user command input via the key input unit 1 and controlled by the controller 3.

Notably, there may be instances where the user decides, shortly after the wash cycle begins and during the washing, to include additional laundry with the original amount of laundry that was sensed to determine the wash cycle performance. In the washing machine of the related art as described above, however, if additional laundry is put in the washing machine during the wash cycle, i.e., with the water level set according to the sensed laundry amount, the additional laundry cannot be detected, and the water supply is thus inappropriate. To add laundry into the above washing machine shortly after the initiation of a wash course, the proceeding wash course should be ended and a new wash course initiated, so that a selected wash course is appropriately performed according to the new laundry amount. Otherwise, the water supply for the additional laundry is improper.

SUMMARY OF THE INVENTION

Accordingly, the present invention is directed to a washing machine control method that substantially obviates one or more of the problems due to limitations and disadvantages of the related art.

An object of the present invention, which has been devised to solve the foregoing problem, lies in providing a washing machine control method, by which a wash course, and in particular, a corresponding supply of water, are appropriately controlled by sensing a laundry amount whenever a door is opened after initiation of a wash cycle of the wash course.

It is another object of the present invention to provide a washing machine control method, which enables an appropriate wash course control regardless of an addition of laundry into the washing machine shortly after starting a wash operation.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a method for controlling a washing machine provided with a door having means for determining an opened/closed status of the door. The method comprising steps of sensing a first wet laundry amount after initiating a wash cycle of a wash course; sensing a second wet laundry amount upon detection of an abnormal open state of the door during the wash cycle; and controlling the wash course based on the most recently sensed wet laundry amount.

Preferably, the first wet laundry amount sensing step is performed periodically throughout the wash cycle, and the detection of an abnormal open state of the door occurs during a predetermined time period following the initiation of the wash cycle. The method may further include a step of resetting the wash cycle if the abnormal open state of the door occurs before a predetermined point of the wash cycle.

The present invention determines whether laundry is added to a washing machine during the execution of a wash cycle, and in particular during an early portion thereof, so that a selected wash course and corresponding water level can be controlled according to the most accurate sensing of an amount of laundry in the washing machine. The selected wash course includes a wash pattern as well as washing, rinsing, and dewatering counts and durations, respectively, and may include such parameters as the concentration of detergent and the like in the water. The wash pattern, which is set at the time of initiating a wash course, is determined by a user command and other factors, such as laundry amount, and includes such particulars as rinse count, motor speed, duration of motor operation, and a control angle.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

The present invention makes use of a washing machine provided with a door having means for determining an opened or closed status of the door.

Figure 3:
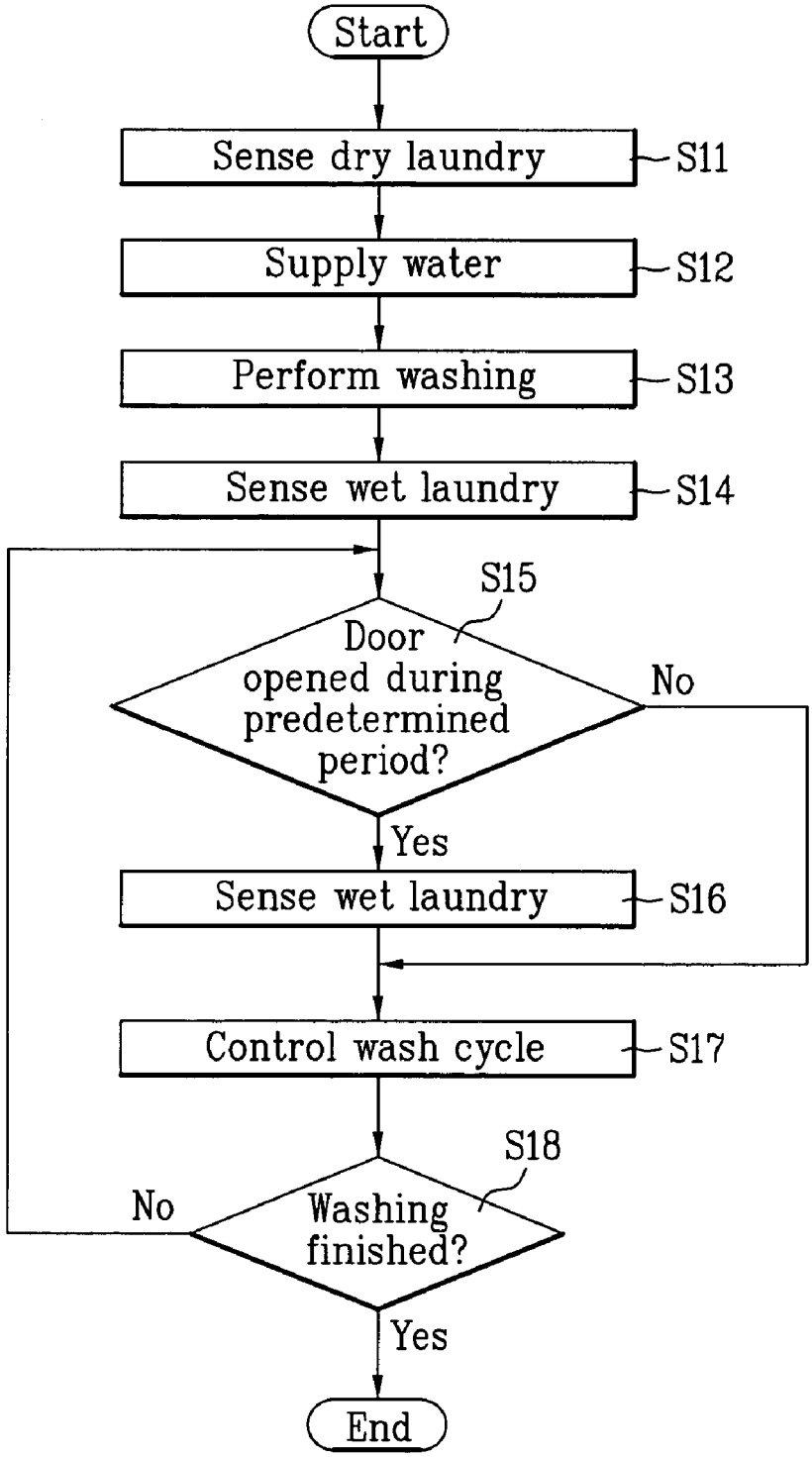
FIG. 3 is a flowchart illustrating a laundry drier control method according to an embodiment of the present invention.

Referring to FIG. 3, illustrating a laundry drier control method according to an embodiment of the present invention, once a user starts the operation of a washing course, a dry laundry amount is sensed in a step S11, and then water is supplied in a step S12 according to the sensed amount. Once the water reaches a predetermined level, washing is performed in a step S13 according to a predetermined wash course. Once the wash cycle is underway, a wet laundry amount is sensed in a step S14. Sensing of the wet laundry amount may be performed periodically throughout the wash cycle.

Meanwhile, in a step S15, it is determined whether the door experiences an abnormal state of opening during a predetermined period following the initiation of the wash cycle. If so, the wet laundry amount is sensed again in a step S16.

Therefore, the wash cycle can be controlled in a step S17 based on the most accurate, i.e., the most current or recent, sensing of the laundry amount. A step S18 determines whether the wash cycle is finished. In doing so, it should be noted that there may be additional instances of the door being opened and laundry added, whereby the step S17 is executed for the most recent sensing of the laundry amount. Thereafter, the remainder of the wash course is controlled according to the laundry amount sensed during the above-described wash cycle.

Therefore, according to the present invention, if the user opens the door to add laundry to the washing machine while the wash cycle is being executed, a washing machine adopting the present invention senses the additional laundry to automatically control the wash course accordingly. It should be appreciated here that the description has precluded a removal of a portion of the laundry during the wash cycle, due to matters of impracticality, but the principles of the present invention are nevertheless applicable.

Figure 4:
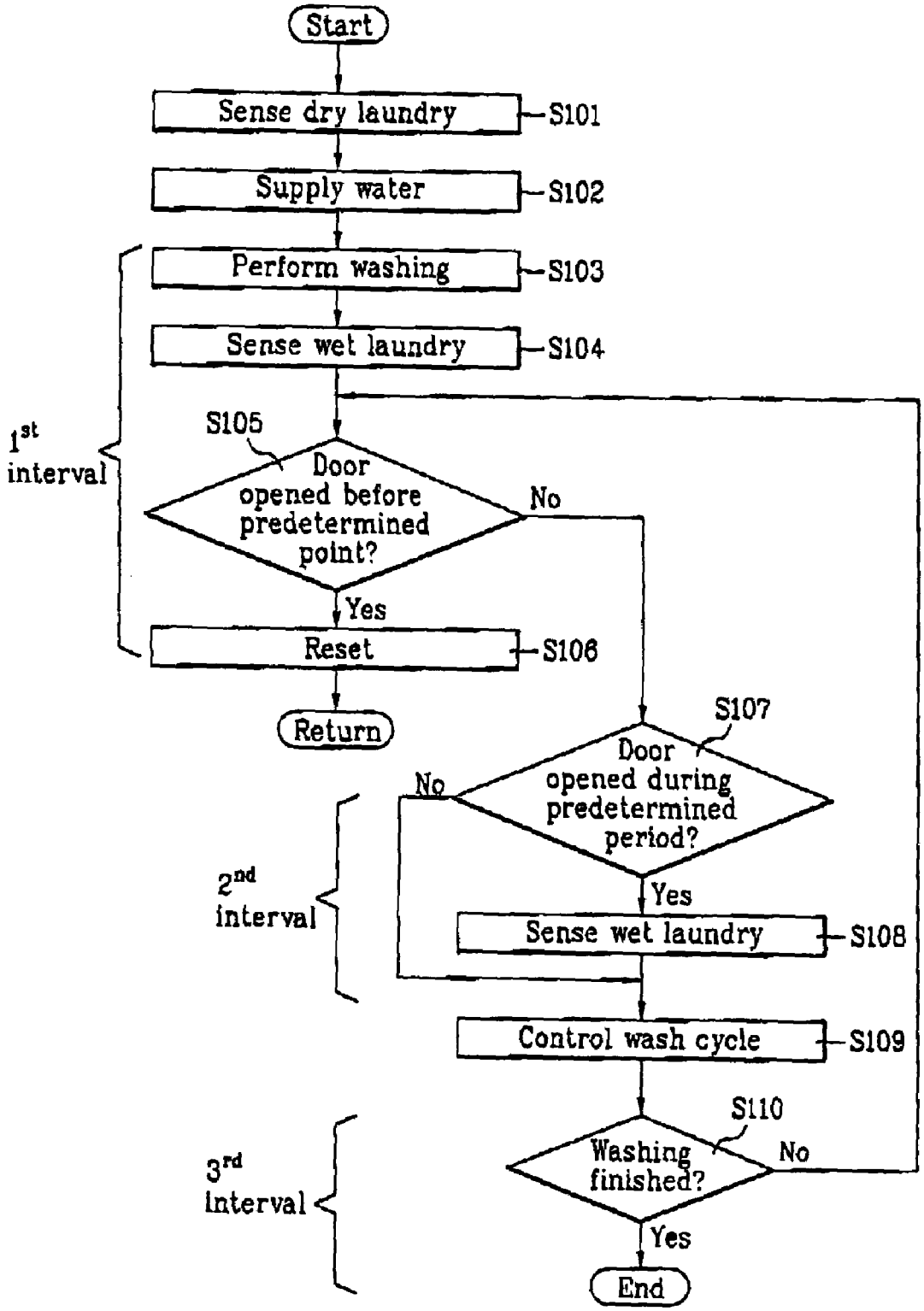
FIG. 4 is a flowchart illustrating a laundry drier control method according to an another embodiment of the present invention.

Referring to FIG. 4, illustrating a laundry drier control method according to an embodiment of the present invention, once a user starts the operation of a washing course, a dry laundry amount is sensed in a step S101, and then water is supplied in a step S102 according to the sensed amount. Once the water reaches a predetermined level, washing is performed in a step S103 according to a predetermined wash course. Once the wash cycle is underway, a wet laundry amount is sensed in a step S104. Sensing of the wet laundry amount may be performed periodically throughout the wash cycle.

Figure 1:
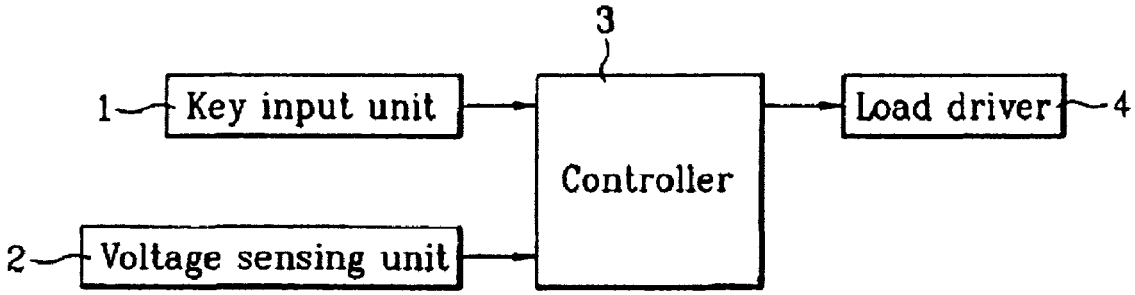
FIG. 1 RELATED ART
FIG. 1 is a block diagram of a washing machine according to a related art.
Figure 2:
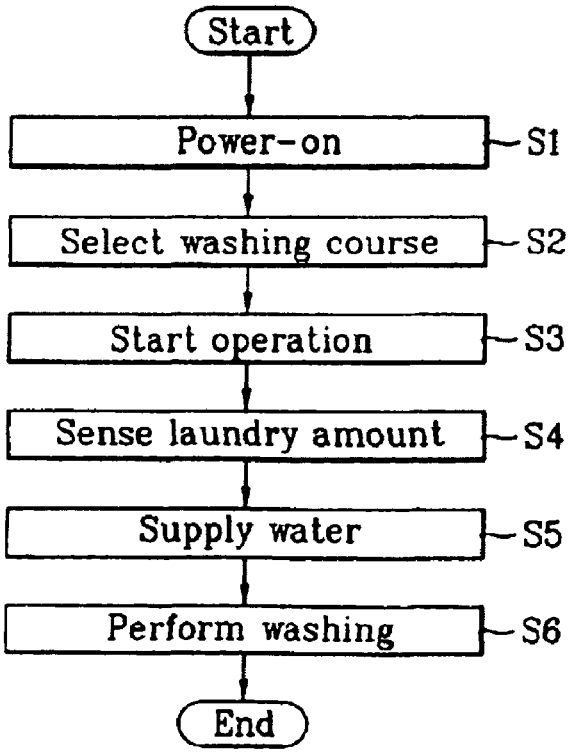
FIG. 2 RELATED ART
FIG. 2 is a flowchart for explaining an operating method of a washing machine according to a related art.

It is determined in a step S105 whether the door experiences an abnormal state of opening prior to a predetermined point of the wash cycle, after the initiation of the wash cycle. If so, the wash cycle is reset in a step S106. A resetting of the wash cycle results in a return to the step S2 of FIG. 2.

On the other hand, if the wash cycle progresses beyond the predetermined point and the door experiences in a step S107 an abnormal state of opening prior to end of a predetermined period following the initiation of the wash cycle (corresponding to the predetermined period of the embodiment of FIG. 3), the wet laundry amount is sensed again in a step S108. Therefore, the wash cycle can be controlled in a step S109 based on the most accurate, i.e., the most current or recent, sensing of the laundry amount. A step S110 determines whether the wash cycle is finished.

In doing so, it should be noted that there may be additional instances of the door being opened and laundry added, whereby the step S109 (or S17) is executed for the most recent sensing of the laundry amount. Thereafter, the remainder of the wash course is controlled according to the laundry amount sensed during the above-described wash cycle. The wash cycle and the wash course continue as above for the remaining time according to the selected wash course. If the door remains closed or experiences an abnormal state of opening after the lapse of the predetermined period, the wash cycle is performed according to the dry laundry amount sensing of the step S101 (or S11) or the most recent wet laundry amount sensing of the step S108 (or S16), even if there is a further increase in the amount of laundry.

Therefore, according to the method of the present invention, the washing cycle is divided into three predetermined time intervals in which the point (time) of detecting an abnormal "door-opened" state signals the potential for an increase in the amount of laundry, where the first predetermined time interval extends from the initiation of the wash cycle to the predetermined point, the second predetermined time interval extends from the predetermined point to the end of the predetermined time period, and the third predetermined time interval extends onward from the end of the predetermined time period. That is, the first predetermined time interval is allocated for a wash cycle resetting step, the second predetermined time interval is allocated for a second wet laundry amount sensing step and a wash course controlling step, and the third predetermined time interval is allocated for the wash course controlling step only.

By adopting the method of the present invention for a washing machine provided with a door having means for determining an opened/closed status of the door, a wash cycle of a wash course can be executed more effectively by automatically controlling the wash course, and in particular, the supply of water to correspond to the increased laundry amount as sensed during the wash cycle. The control may be selectively applied according to the point in time of the door being opened and according to any increase in the amount of the laundry that may be sensed after the wash cycle is underway. If the laundry amount is increased before the lapse of a predetermined time period for automatic control, an overload condition of the motor and the like may be prevented.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method for controlling a washing machine, said washing machine having means for determining an open state or a closed state of a door of the washing machine, the method comprising steps of:

sensing a first wet laundry amount after initiating a wash cycle of a wash course;

resetting the wash cycle upon detection of an open state of the door during the wash cycle before a predetermined point of the wash cycle;

controlling the wash course by dividing the wash cycle into three predetermined time intervals;

wherein a first predetermined time interval is allocated for a step of resetting the wash cycle if the detection of the open state of the door;

a second predetermined time interval is allocated for a step of sensing a second wet laundry amount if the detection of the open state of the door, and a step of controlling the wash course based on the second wet laundry amount; and a third predetermined time interval is allocated for a step of maintaining the wash course;

wherein the first predetermined time interval starts from an initiation of the wash cycle, the third predetermined time interval finishes at an end of the wash cycle, and the second predetermined interval is between the first predetermined time interval and the third predetermined time interval.

2. The method as claimed in claim 1, wherein said first wet laundry amount sensing step is performed periodically throughout the wash cycle.

3. The method as claimed in claim 1, further comprising steps of:

sensing a dry laundry amount before initiating the wash cycle; and supplying water to a tub according to the sensed dry laundry amount.

* * * * *